United States Patent [19]

Skipworth

[11] 4,089,514

[45] May 16, 1978

[54] PAPER FOLDING APPARATUS

[76] Inventor: James Ernest Skipworth, 2128 Windrock, El Paso, Tex. 79925

[21] Appl. No.: 720,610

[22] Filed: Sep. 7, 1976

[51] Int. Cl.[2] ..... B65H 45/22

[52] U.S. Cl. ..... 270/94; 270/5

[58] Field of Search ..... 270/86–94, 270/66, 5, 20

[56] References Cited

U.S. PATENT DOCUMENTS

| | | | |
|---|---|---|---|
| 229,479 | 6/1880 | Schelfield | 270/94 |
| 878,829 | 2/1908 | Roesen | 270/94 |
| 1,003,023 | 9/1911 | Ziegler | 270/86 |
| 1,305,748 | 6/1919 | Shapiro | 270/86 |
| 3,048,390 | 8/1962 | Salmon | 270/73 |
| 3,193,904 | 7/1965 | Evans | 270/86 |
| 3,345,965 | 10/1967 | Gore | 270/94 |

*Primary Examiner*—Edgar S. Burr
*Assistant Examiner*—A. Heinz
*Attorney, Agent, or Firm*—Edward E. Sachs

[57] ABSTRACT

Apparatus for folding an elongated flat paper web to a shape for use in binding one edge of a stack of blueprints or the like includes first and second folding devices positioned so that the paper web moves through the first folding device in one direction and through the second folding device in an opposite direction. The folding devices include cooperating channels, at least one of which is twisted approximately 180° and folded over in order to change the cross-sectional shape of the passage through the folding device between its entrance and exit ends for imparting desired longitudinal folds to the flat paper web.

12 Claims, 7 Drawing Figures

FIG. 2
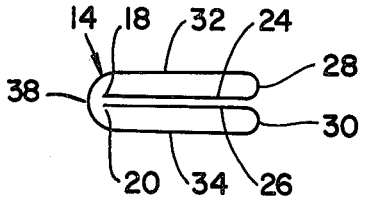
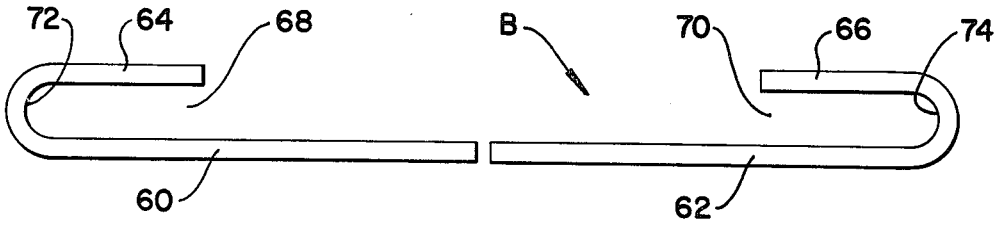
FIG. 3
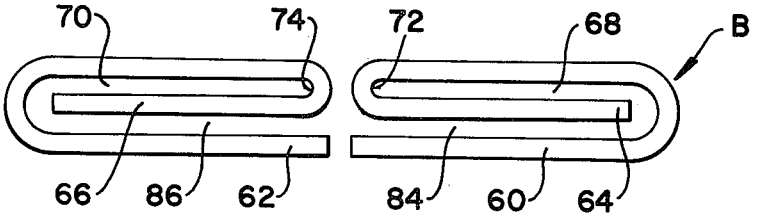
FIG. 4
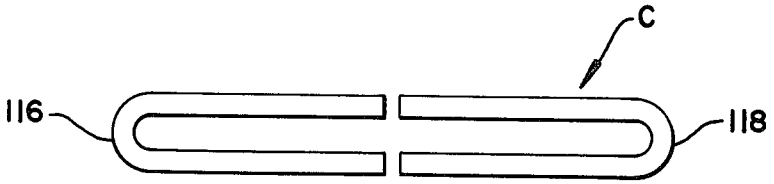
FIG. 5
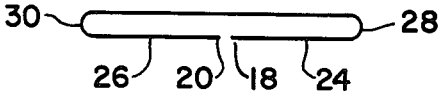
FIG. 7
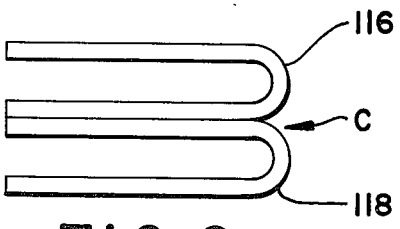
FIG. 6

PAPER FOLDING APPARATUS

The invention relates generally to apparatus for folding paper and, more particularly, to such an apparatus for folding a relatively narrow flat paper web to a shape for use in binding one edge of a stack of blueprints or the like.

Paper binders for binding one edge of a stack of blueprints or the like are commonly made by manually folding lengths of flat paper longitudinally to a desired shape. At least three longitudinal folds are made in order to form a paper binder which is generally U-shaped and has double thickness for stapling or otherwise attaching same to one edge of a stack of blueprints or the like. In forming binders this way, desired lengths of flat paper web are first cut from a flat sheet or an elongated roll and the individual lengths are manually folded. This operation is very time consuming and the necessary manual labor is very expensive. Furthermore, cutting a flat paper web to desired lengths and then longitudinally folding same creates a storage problem where it is desired to have a supply of binders on hand because the cut and folded binders are cumbersome to store. Also, binders may be desired in varying lengths and this makes storage of pre-folded binders even more difficult unless one binder size of the largest desired is pre-folded. Cutting long pre-folded binders to shorter lengths is wasteful of binder material.

Devices of various types are known for folding paper longitudinally into desired shapes as the paper moves longitudinally through a folding device. Known folding devices include forming devices having varying cross-sectional passage shapes along their length for progressively folding paper or other material as it moves longitudinally through the device. However, there are at present no commercially available folding devices for folding a flat web of paper to a desired shape for use in binding one edge of a stack of blueprints or the like. More particularly, there is no known device of this type which can efficiently and accurately impart desired longitudinal folds to a flat web of paper which can then be cut into desired lengths for use as binders. There is especially no known folding device which forms part of, or can be added as an attachment to, a conventional blueprint machine so that the machine which is used to make blueprints can be used to make the binders and impart a desired indicia on the binders if so requested by a user or customer.

It is therefore the primary object of the present invention to provide an improved paper folding apparatus.

It is a further object of the present invention to provide a paper folding apparatus which is particularly adapted for use in forming binders of a desired shape from a flat paper web.

It is another object of the present invention to provide a paper folding apparatus which is very compact, and is also very simple in construction and operation.

It is an additional object of the present invention to provide a paper folding apparatus for use with a blueprint machine so that a flat web of paper can be imparted with desired indicia in the blueprint machine prior to being longitudinally folded by the folding apparatus.

It is also an object of the invention to provide a paper folding apparatus which can be used by itself, or can be attached to or built into a blueprint machine.

An aspect of the present invention resides in first and second spaced folding devices which are positioned so that the flat paper web moves through the first folding device in a first direction and moves through the second folding device in an opposite direction. In the preferred arrangement, the first and second folding devices are positioned generally with one above the other and the paper web is inverted in moving between the first and second folding devices.

Creasing means is preferably provided between the two folding devices and subsequent to the second folding device for creasing the relatively loose longitudinal folds imparted to the web during passage thereof through the folding devices. Each folding device includes a pair of channels having longitudinal openings positioned in facing opposed relationship at the entrance end of each folding device. At least one channel is twisted approximately 180° and folded over so it is displaced inwardly approximately the same distance as the width of a channel. This means that the width of the exit opening for each folding device is approximately onehalf the width of the entrance opening. An arrangement of this type progressively varies the shape of the passage through the folding device for imparting the desired fold to the web as it moves longitudinally through the passage. The smooth transition in the shape of the passage between its entrance and exit ends provides enhanced folding action without wrinkling of the web material.

The first folding device preferably includes a generally flat central portion having spaced-apart opposite channels with their longitudinal openings positioned in facing opposed relationship. Each channel is twisted approximately 180° and folded over inwardly so that the entrance channels have their longitudinal openings facing outwardly away from one another at the exit end of the first folding device. However, folding over of the entrance channels forms additional exit channels by cooperation of the entrance channels with the flat central portion at the exit end of the folding device. The bases of the exit channels communicate with the longitudinal openings of the entrance channels so that the opening at the exit end is generally like that of two U's positioned with their open mouths facing one another.

A web hold down and guide means is preferably located between the entrance channels of the first folding device for guiding the flat paper web and holding it against the flat central portion as it is pulled into the twisted and folded over portions of the first folding device.

The second folding device comprises a pair of opposed channels having longitudinal openings positioned in facing opposed relationship. One channel is twisted and folded over so that the exit end of the second folding device shows the channels positioned in adjacent relationship with their longitudinal openings facing outwardly in the same direction.

In a preferred arrangement, the flat paper web is fed or pulled from a roll past an image forming means for imparting an image to the paper web before it is pulled through the folding devices. Subsequent to longitudinal movement of the web through the folding devices, it is fed through developing means for developing the image thereon and the folded web is then rolled up onto a storage roll. Any desired decorative or informative indicia may be imparted to the paper web. For example, where the binders are used by an architectural or engineering consulting firm, the name of the firm may be printed on the paper web by the image forming means so it will appear in a viewable location on the binder when used for binding an edge of stacked blueprints or the like.

For a better understanding of the present invention, together with other and further objects thereof, reference is had to the following description taken in connection with the accompanying drawings, and its scope will be pointed out in the appended claims.

In the drawing

FIG. 2 is a cross-sectional elevational view taken generally on line 2—2 of FIG. 1;

FIG. 3 is an end elevational view taken generally on line 3—3 of FIG. 1;

FIG. 4 is an end elevational view of a folding device taken generally on line 4—4 of FIG. 1;

FIG. 5 is an end elevational view of a folding device taken generally on line 5—5 of FIG. 1;

FIG. 6 is an end elevational view taken generally on line 6—6 of FIG. 1; and

FIG. 7 is a cross-sectional elevational view taken generally on line 7—7 of FIG. 1.

Figure 1:
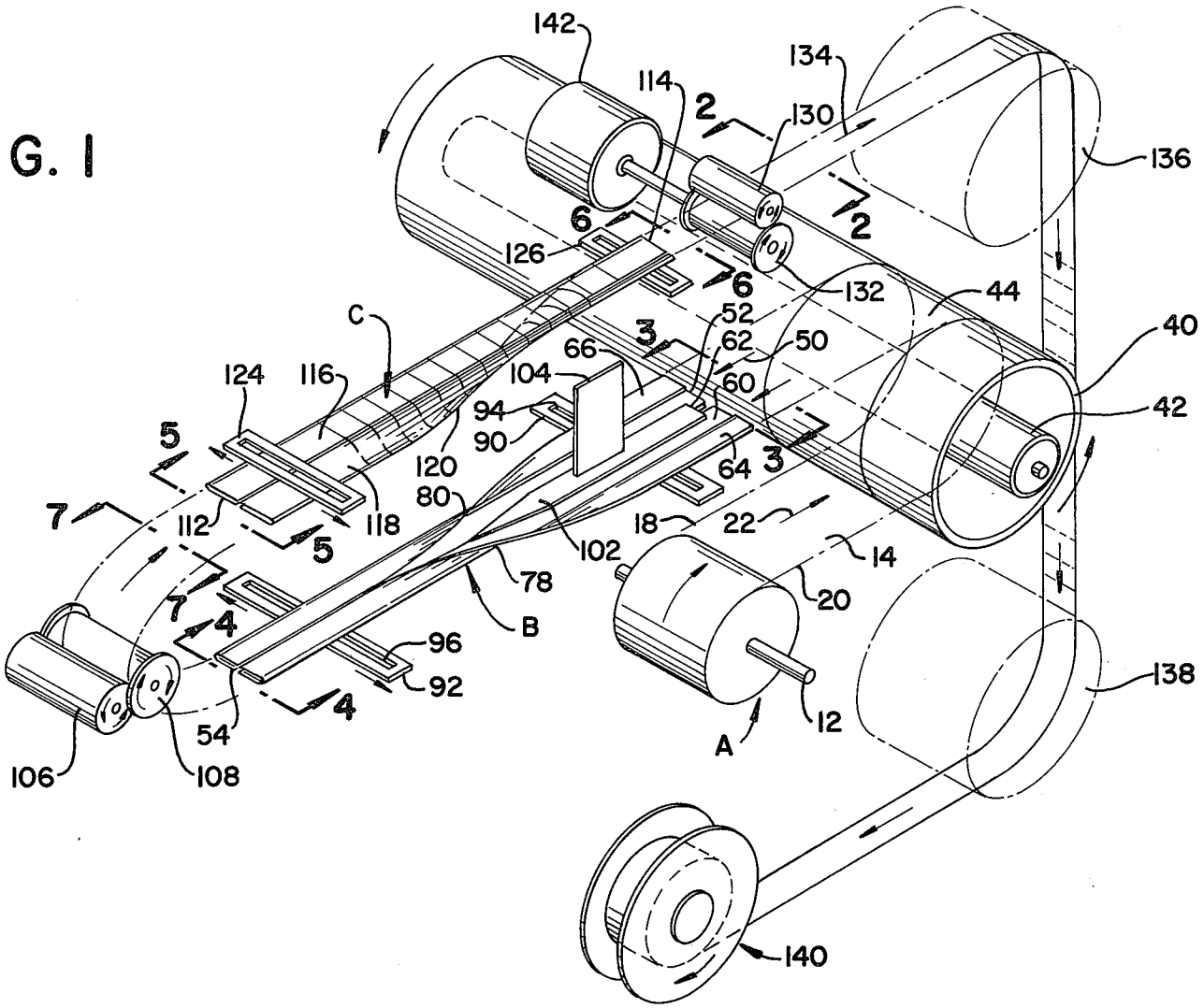
FIG. 1 is a perspective illustration of a paper folding apparatus constructed in accordance with the present invention.

Referring now to the drawing, and particularly FIG. 1, there is shown a roll of paper A suitably mounted for rotation on a spindle 12 and being formed from a relatively narrow flat paper web 14 coiled upon itself many times. The flat paper web 14 may be of any desired width, and just by way of example has been of a four inch width in one device. It will be recognized that the apparatus can be constructed for handling paper of narrower or greater width. The flat paper web 14 has opposite longitudinal side edges 18 and 20, and moves longitudinally from the roll A in the direction of arrow 22. The apparatus finally folds the flat paper web 14 to the shape shown in FIG. 2. The final shape of the paper web for use in binding the edge of a stack of blueprints or the like is generally U-shaped and the legs of the U are of double thickness formed by inner leg portions 24 and 26 between the edges 18 and 20, and longitudinal folds 28 and 30. Outer legs 32 and 34 are defined between a central longitudinal fold 38 and the folds 28 and 30. The flat paper web 14 is folded transversely to approximately one-fourth of its original width. The edge portion of a stack of blueprints or the like is placed between the inner legs 24 and 26, and staples are then driven through the legs and the stacked edges of the blueprints. The legs 24 and 26 are folded over along the longitudinal folds 28 and 30 so that the edges 18 and 20 are located approximately at the midpoint of the paper web.

The apparatus of the present application is particularly suitable for use on a machine known as a blueprint machine. Furthermore, the roll of paper A is preferably a type of paper which is sensitized so an image can be formed thereon for development. The sensitized paper may be of the blue-print or whiteprint type if so desired.

In the arrangement shown, the web of paper 14 moves longitudinally in the direction of the arrow 22 from the roll A around a rotatably mounted transparent drum 40 defining image imparting means and containing an inner light source 42. The outer surface of the drum 40 carries image forming indicia 44 so that the indicia is imparted to the paper web 14 as it moves past the transparent drum 40 with the light source 42 turned on. The indicia 44 may take many forms, and may be the name of a firm or the like. It will be recognized that the folding apparatus may also be used without forming an image on the paper if so desired.

The flat paper web 14 moves longitudinally in the direction of the arrow 50 into a first folding device B having entrance and exit ends generally indicated at 52 and 54. The first folding device B is formed of any suitable substantially rigid material including metal or synthetic plastic. As best shown in FIG. 3, the first folding device B is formed from a pair of cooperating elongated members each having a flat portion 60 and 62 which cooperate with one another to define a flat central base portion of the first folding device B. The outer longitudinal side portions of the pair of elongated members are folded over upwardly and inwardly toward one another as indicated generally at 64 and 66 to define channels 68 and 70 having bases 72 and 74 which are spaced-apart a distance substantially the same as the width of the paper web 14. The shape shown in FIG. 3 is that of the entrance end 52 in FIG. 1 of the first folding device B.

As generally indicated by numerals 78 and 80 in FIG. 1, the folded portions or channels 64 and 66 are twisted approximately 180° and folded over inwardly toward one another so that the exit end 54 of FIG. 1 has the approximate shape as shown in FIG. 4. When the entrance channels of FIG. 3 are twisted approximately 180° and folded over inwardly toward one another, they remain spaced above the flat portions 60 and 62 so that exit channels 84 and 86 are formed. The bases of the exit channels 84 and 86 communicate with the longitudinally open portions of the entrance channels 68 and 70, while the bases 72 and 74 of the entrance channels 68 and 70 in FIG. 4 are positioned closely adjacent one another. The opening at the exit end of the first folding device B may be considered to be like that of two U's positioned with their open mouths facing one another and with the bottom legs of the U's considered connected in a continuous passage by the channels 84 and 86. The top legs of the U's are interrupted by the bases 72 and 74 of the entrance channels. In the position of FIG. 3, the entrance channels 68 and 70 have their longitudinal openings positioned in facing opposed relationship to one another and are spaced-apart a substantial distance. After twisting and folding intermediate the entrance and exit ends of the first folding device B, the entrance channels have their longitudinal openings positioned to face outwardly in opposite directions as shown in FIG. 4. In the showing of FIG. 4, the exit opening defined from the base 72 through the channels 68, 84, 86 and 70 over to the base 74 defines a distance which is approximately the same as the width of the paper web 14.

As shown in FIG. 1, mounting brackets 90 and 92 having suitable transverse slots 94 and 96 therein are suitably secured to the first folding device B for mounting and adjusting same. Threaded studs on the frame of the machine may extend through the slots 94 and 96 for receiving wing nuts or the like to releasably mount and clamp the first folding device B in position. Loosening of the wing nuts allows transverse adjustment of the first folding device B for properly aligning same with the flat paper web 14 as it comes from the transparent drum 40. This mounting arrangement provides adjusting means for transversely adjusting the first folding device B.

Hold down and guide means is provided adjacent the entrance end 52 of the first folding device B for holding and guiding the paper web 14 on the flat central portion of the first folding device B as the web moves along between the entrance channels. The hold down and guide means may include a flat plate 102 running centrally longitudinally along the first folding device B and tapering to a point where the entrance channels are twisted and folded over as at 78 and 80. The plate 102 is located slightly above the flat central portion of the first folding device and has an upstanding mounting plate 104 suitably secured to the frame of the machine. If desired, the hold down and guide device may be lightly spring biased toward the flat central portion of the first folding device B or may be biased toward same by the force of gravity. The flat paper web 14 is folded to the general shape shown in FIG. 7 after passing through the first folding device B. FIG. 7 shows the paper web in an inverted position from the position it is in immediately upon exiting from exit end 54 of the first folding device B. Upon moving from the exit end 54 of the first folding device B, the paper web moves between a pair of rotatably mounted creasing rolls 106 and 108, one of which may be biased toward the other for creasing the longitudinal folds 28 and 30 imparted to the web by the first folding device B. The rolls 106 and 108 are also positioned for inverting the paper web and reversing its direction of movement so that it moves through a second folding device C in a direction opposite from that in which it moves through the first folding device B. This also makes the device relatively compact.

The second folding device C has an entrance and generally indicated by numeral 112 and an exit end generally indicated by numeral 114. The second folding device C is in the form of a pair of channels 116 and 118 positioned at the entrance end 112 with their longitudinal openings facing one another in opposed relationship as shown in FIG. 5. The inner bases of the channels 116 and 118 are spaced-apart approximately the same distance as the width of the web in FIG. 7 across the folds 28 and 30. Intermediate the entrance and exit ends 112 and 114, the channel 118 is twisted approximately 180° and folded over as generally indicated at 120 in FIG. 1. The exit end of the second folding device C has the shape shown in FIG. 6 with the exit portions of the channels positioned in side-by-side relationship so that their longitudinal openings face outwardly in the same direction and their bases are aligned with one another. Therefore, the exit opening 114 of FIG. 1 is generally U-shaped for folding the paper web from the shape of FIG. 7 to the shape of FIG. 2. The second folding device C folds the web of FIG. 7 substantially centrally longitudinally to provide a central longitudinal fold 38. Suitable brackets indicated generally at 124 and 126 are suitably secured to the second folding device C and have transversely elongated slots therein for receiving threaded studs on the frame of the machine. Wing nuts on the threaded studs releasably secure the brackets and the second folding device C in a desired position. Loosening of the wing nuts provides transverse adjustment for properly aligning the second folding device with the paper web as it moves from between the rollers 106 and 108.

Upon moving from the exit end 114 of the second folding device C, the web passes between creasing rolls 130 and 132, one of which may be biased toward the other for creasing the longitudinal fold 38 imparted to the web by the second folding device C. The folded web then moves in the direction of arrow 134 in FIG. 1 around a drum 136. The folded web may then move to a developing section of the machine where it is exposed to ammonia vapor or other developing material depending upon the type of sensitized paper used. Subsequent to movement of the folded web through the development section, the web moves around a drum 138 and onto a rotatably driven reel 140 which coils the folded web into a convenient roll which can later be uncoiled for cutting to desired lengths. A plurality of rolls of folded web can be run on the device and boxed for storage or shipment.

In the preferred arrangement shown in FIG. 1, the first and second folding devices B and C are generally horizontally positioned with second folding device C above the first folding device B. The folds imparted to the paper web 14 by the first folding device B are formed by folding the opposite side portions of the paper web upwardly out of the plane of the web and then downwardly. The web is reversed before passing into the second folding device C where the fold imparted to the web is made by folding one-half of the web downwardly out of its plane and then upwardly over onto itself. Therefore, the folding devices B and C are positioned so that the folding direction imparted to the web in the first folding device B is in an opposite direction from the folding direction imparted to the web by the second folding device C.

Improved folding apparatus of the present application may be assembled as a unitary part of a blueprint machine or the like. In addition, it is possible to construct the folding apparatus as a sub-assembly so it can easily be attached to a blueprint machine or the like. Also, it is possible to construct the folding apparatus as a self-contained unit so it can be used simply for longitudinally folding a relatively narrow flat paper web in the absence of a blueprint machine or the like.

The flat paper web may be pulled longitudinally through the entire apparatus of FIG. 1 by having the takeup roll 140 suitably rotatably driven. However, and if so desired or necessary, supplemental driving may be provided as shown by a driving motor 142 for the roll 132 subsequent to the second folding device C. Various of the other drums, rolls or image producing drum may also be rotatably driven. In any event, the flat paper web is preferably pulled longitudinally through the entire apparatus as the longitudinal folding progressively takes place on the entire length of paper web. The first folding device B longitudinally folds the flat paper web to approximately one-half its original width. The second folding device C then folds the web to a width which is approximately one-half of the first folded width imparted to the web by the first folding device B. In other words, the two folding devices decrease the total width of the paper web to approximately one-fourth its original size.

While there has been described what is at present considered to be the preferred embodiment of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. Apparatus for longitudinally folding a paper web moving longitudinally comprising; a folding device having entrance and exit ends and an elongated flat central portion lying along the path of the moving web, said device having transversely spaced-apart elongated channels, said channels having entrance channel portions disposed on opposite sides of the central portion and opening toward one another at said entrance end, said channels being longitudinally twisted approximately 180° along their length and folded over toward one another to overlie said central portion so that said channels open in opposite directions away from one another at said exit end and overlie said central portion to form exit channel portions which open toward one another at said exit end, said exit channel portions communicating with open portions of the twisted channels at the exit end so that the cross-sectional shape of the folding device at said exit end is generally like that of two U's positioned with their openings facing one another.

2. The apparatus of claim 1 wherein said folding device is formed in two longitudinal parts and including adjustment means for transversely adjusting said parts for properly aligning same with the web of paper.

3. The apparatus of claim 1 including guide means adjacent said entrance end between said entrance channels for guiding a paper web along said central portion from said entrance channels to the general area where said entrance channels are twisted and folded over.

4. Apparatus for folding a flat paper web to form binders for use in binding the edge of a stack of blueprints or the like, the binders being generally U-shaped and having double thickness leg portions, comprising: folding means for longitudinally folding a flat paper web to the shape of the binders as the paper web moves longitudinally through said folding means, image forming means for imparting a visual image to said paper web prior to passage of same through said folding means, a paper web supply roll positioned adjacent said image forming means on the same side thereof as said folding means and below said folding means, said paper web passing in a first direction from said supply roll to said image forming means and in an opposite second direction from said image forming means to said folding means, said paper web passing below and over said image forming means in passing from said supply roll to said folding means, and said paper web passing from said folding means in said first direction over the top of said image forming means to a takeup roll positioned generally below said supply roll, and wherein said folding means comprises a folding device having entrance and exit ends and an elongated flat central portion lying along the path of the moving web, said device having transversely spaced-apart elongated channels, said channels having entrance channel portions disposed on opposite sides of the central portion and opening toward one another at said entrance end, said channels being longitudinally twisted approximately 180° along their length and folded over toward one another to overlie said central portion so that said channels open in opposite directions away from one another at said exit end and overlie said central portion to form exit channel portions which open toward one another at said exit end, said exit channel portions communicating with open portions of the twisted channels at the exit end so that the cross-sectional shape of the folding device at said exit end is generally like that of two U's positioned with their openings facing one another.

5. The apparatus of claim 4 wherein said image forming means is part of a blueprint machine and said folding means is attached to said machine.

6. Apparatus for folding an elongated web of paper moving longitudinally comprising; first and second spaced folding devices through which a web of paper passes successively for imparting different longitudinal folds thereto, said first folding device having entrance and exit ends, said exit end having a width approximately one-half the width of said entrance end, said first folding device including a pair of spaced elongated channels having longitudinal openings positioned in facing opposed relationship at said entrance end and being positioned facing outwardly in opposite directions at said exit end, and said channels between said entrance and exit ends being twisted approximately 180° and transversely displaced, said second folding device being spaced after said first folding device to fold said web further.

7. The apparatus of claim 6 wherein said first folding device is positioned for longitudinal movement of a paper web therethrough in one direction and said second folding device is positioned for longitudinal movement of the paper web therethrough in an opposite direction.

8. The apparatus of claim 6 including guide means positioned between said channels adjacent said entrance end for guiding the web of paper through said channels.

9. The apparatus of claim 6 including adjustment means for transversely adjusting said channels for aligning same with the paper web.

10. The apparatus of claim 6 wherein said second folding device has second entrance and second exit ends and includes a pair of elongated second channels having second longitudinal openings positioned in facing opposed relationship at said second entrance end, one of said second channels from said second entrance end toward said second exit end being twisted 180° and transversely displaced in alignment with the other said second channel for positioning said second longitudinal openings in side-by-side relationship facing in the same direction at said second exit end.

11. The apparatus of claim 6 including image forming means for imparting a predetermined image to a paper web prior to passage thereof through said first folding device.

12. The apparatus of claim 6 wherein said first folding device imparts a pair of transversely-spaced longitudinal folds to a paper web passing therethrough with such folds being positioned to locate the opposite longitudinal edges of the paper web facing one another at approximately the transverse midpoint of the paper web, and said second folding device imparts one longitudinal fold to the paper web at approximately the transverse midpoint thereof.

* * * * *